US010959021B2

(12) United States Patent
Nakamura

(10) Patent No.: US 10,959,021 B2
(45) Date of Patent: Mar. 23, 2021

(54) SPEAKER DEVICE AND AUDIO DATA REPRODUCTION SYSTEM

(71) Applicant: SONY CORPORATION, Tokyo (JP)

(72) Inventor: Motonori Nakamura, Saitama (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/485,861

(22) PCT Filed: Jan. 30, 2018

(86) PCT No.: PCT/JP2018/002977
§ 371 (c)(1),
(2) Date: Aug. 14, 2019

(87) PCT Pub. No.: WO2018/173487
PCT Pub. Date: Sep. 27, 2018

(65) Prior Publication Data

US 2020/0059723 A1 Feb. 20, 2020

(30) Foreign Application Priority Data

Mar. 23, 2017 (JP) ..... JP2017-056881

(51) Int. Cl.
*H04R 5/04* (2006.01)
*H04R 1/02* (2006.01)
*H04R 5/02* (2006.01)

(52) U.S. Cl.
CPC ..... *H04R 5/04* (2013.01); *H04R 1/025* (2013.01); *H04R 5/02* (2013.01); *H04R 2420/07* (2013.01)

(58) Field of Classification Search
CPC ..... H04R 1/025; H04R 2420/07; H04R 5/02; H04R 5/04
See application file for complete search history.

(56) References Cited

U.S. PATENT DOCUMENTS

2016/0345112 A1 11/2016 Park et al.

FOREIGN PATENT DOCUMENTS

| | | | |
|---|---|---|---|
| CN | 106465035 | A | 2/2017 |
| EP | 3123748 | A1 | 2/2017 |
| JP | 2011-004077 | A | 1/2011 |
| JP | 2017-513438 | A | 5/2017 |
| KR | 10-2016-0135587 | A | 11/2016 |
| KR | 10-2016-0138512 | A | 12/2016 |
| MX | 2016012359 | A | 2/2017 |
| SE | 1451466 | A1 | 9/2015 |
| TW | 201601555 | A | 1/2016 |
| WO | 2015/087729 | A1 | 6/2015 |
| WO | 2015/147737 | A1 | 10/2015 |

OTHER PUBLICATIONS

International Search Report and Written Opinion of PCT Application No. PCT/JP2018/002977, dated Apr. 17, 2018, 10 pages of ISRWO.

*Primary Examiner* — Regina N Holder
(74) *Attorney, Agent, or Firm* — Chip Law Group

(57) ABSTRACT

A speaker device includes a first output section that outputs a first signal and a second output section that outputs a second signal distinguishable from the first signal.

9 Claims, 4 Drawing Sheets

SPEAKER DEVICE AND AUDIO DATA REPRODUCTION SYSTEM

CROSS REFERENCE TO RELATED APPLICATIONS

This application is a U.S. National Phase of International Patent Application No. PCT/JP2018/002977 filed on Jan. 30, 2018, which claims priority benefit of Japanese Patent Application No. JP 2017-056881 filed in the Japan Patent Office on Mar. 23, 2017. Each of the above-referenced applications is hereby incorporated herein by reference in its entirety.

TECHNICAL FIEL D

The present disclosure relates to a speaker device and an audio data reproducing system.

BACKGROUND ART

From the past, there has been proposed a position detection system that detects a position of a speaker (e.g., see Patent Literature 1).

CITATION LIST

Patent Literature

Patent Literature 1: Japanese Patent Application Laid-open No. 2011-4077

DISCLOSURE OF INVENTION

Technical Problem

In this field, it is desirable that the position of the speaker can be more correctly detected.

Therefore, it is one of objects of the present disclosure to provide a speaker device and an audio data reproducing system which are capable of correctly detecting the position of the speaker.

Solution to Problem

The present disclosure is, for example, a speaker device including:

a first output section that outputs a first signal; and a second output section that outputs a second signal distinguishable from the first signal.

Further, the present disclosure is, for example, an audio data reproducing system including:

at least two or more speaker devices; and an audio data supplying device that supplies each of the speaker devices with audio data, in which the speaker device includes a first output section that outputs a first signal, a second output section that outputs a second signal distinguishable from the first signal, a first reception section that receives the second signal, a second reception section that receives the first signal, an identification section that identifies an arrangement position in accordance with results of reception by the first reception section and the second reception section, and a communication section that notifies the audio data supplying device of the arrangement position by communication, and the audio data supplying device includes a supplying section that supplies the speaker device with audio data of a channel by the communication, the channel corresponding to an arrangement position notified by the speaker device.

Advantageous Effects of Invention

In accordance with at least one embodiment of the present disclosure, the position of the speaker can be correctly detected. It should be noted that the effect described here is not necessarily limitative and may be any effect described in the present disclosure. Further, the contents of the present disclosure should not be construed as being limited by the exemplified effect.

MODE(S) FOR CARRYING OUT THE INVENTION

Hereinafter, an embodiment and the like of the present disclosure will be described with reference to the drawings. It should be noted that descriptions will be made in the following order.

<1. Embodiment>

<2. Modified examples>

An embodiment described hereinafter is a favorable specific example of the present disclosure, and the contents of the present disclosure are not limited to the embodiment and the like.

1. Embodiment

[Configuration Example of Audio Data Reproducing System]

Figure 1:
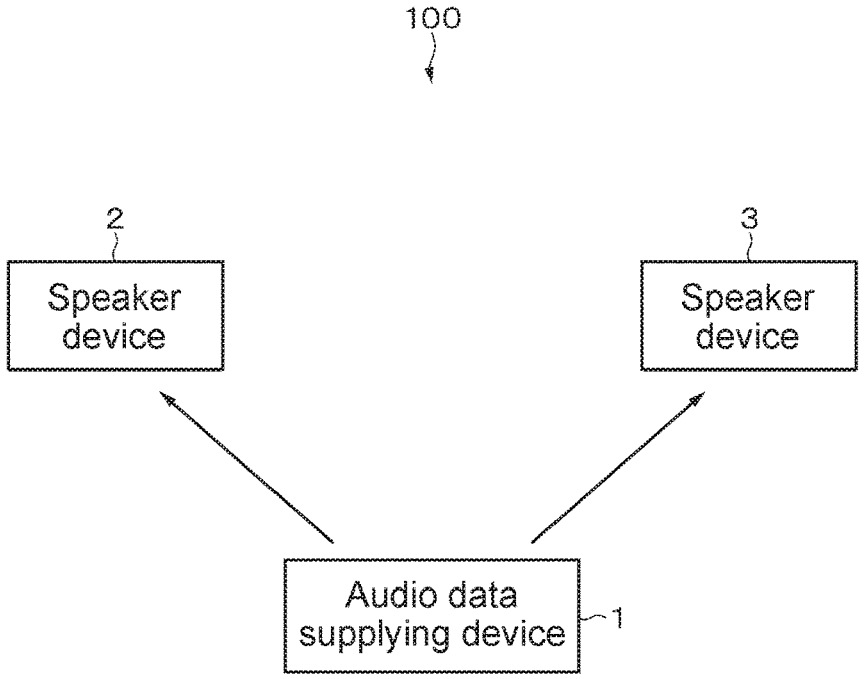
FIG. 1 is a block diagram showing a configuration example of an audio data reproducing system according to an embodiment.

FIG. 1 shows a configuration example of an audio data reproducing system according to an embodiment of the present disclosure. An audio data reproducing system 100 includes an audio data supplying device 1 and two or more speaker devices (in this example, two speaker devices 2 and 3), for example.

Examples of the audio data supplying device 1 can include a personal computer, a sound bar, a reproduction device capable of reproducing content data such as audio data and video data, and the like. The audio data supplying device 1 has a function of amplifying audio data and a function as a switcher that selects audio data corresponding to a predetermined channel from a plurality of channels (e.g., two channels). The audio data supplying device 1 includes a supplying section that supplies the speaker devices 2 and 3 with audio data by communication. The audio data supplied by the audio data supplying device 1 to the speaker devices 2 and 3 may be data stored in a built-in memory of the audio data supplying device 1, data read out by the audio data supplying device 1 from a portable memory, or the like. Any data can be used.

The speaker devices 2 and 3 are devices that reproduce audio data (outputs sound) supplied from the audio data supplying device 1. As an example, the speaker devices 2 and 3 have a portable size and the speaker devices 2 and 3 can be arranged at arbitrary positions. Such a speaker device is also called wireless speaker or the like.

Communication can be performed between the audio data supplying device 1 and the speaker devices 2 and 3. The communication may be wired communication or may be wireless communication. In this example, wireless communication at a relatively short distance (e.g., approximately 1 m (meter) to several m) is performed between the devices. Examples of a short-distance wireless communication can include Bluetooth (registered trademark) and Wi-Fi (registered trademark). Each of the devices includes a well-known configuration according to communication standards.

[Problem Which Should be Considered in Audio Data Reproducing System]

In a case of using a plurality of speaker devices, it is necessary to pay attention to the arrangement and the wire connection. For example, if connection between the speaker devices and an amplifier or switcher on an output side is wired, it is necessary to perform wire connection while taking care not to mistake the left for the right of a terminal or line to be actually connected. On the other hand, in a case where the audio data supplying device 1 and the speaker devices 2 and 3 are wirelessly connected like this embodiment, it has been necessary to set specific identifier (ID), addresses, and the like of the speaker devices 2 and 3 to the audio data supplying device 1 so as to output correct signals to the speaker devices 2 and 3. In particular, in a case where the speaker devices 2 and 3 are portable speaker devices, it is necessary to correctly switch the arrangement positions in accordance with switching between stereo reproduction and surround reproduction. However, in a case where it is performed by the user, errors of the arrangement positions are often caused. Further, since the setting work of the speaker device can be a burden on the user, it is desirable that the speaker devices 2 and 3 identify their own arrangement positions and reproduce audio data of channels depending on the arrangement positions. In view of this, the embodiment of the present disclosure will be described in more detail.

[Configuration Example of Speaker Device]

Figure 2:
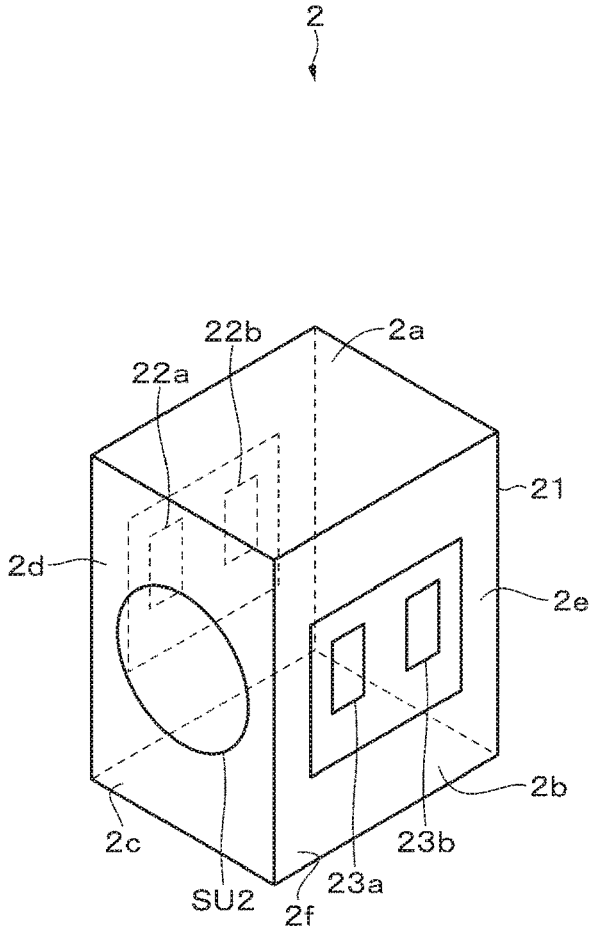
FIG. 2 is a diagram showing an outer appearance example of a speaker device according to the embodiment.

FIG. 2 shows an outer appearance example of a speaker device 2 according to the embodiment of the present disclosure. The speaker device 2 includes an enclosure 21 having a rectangular parallelepiped shape, for example. The enclosure 21 includes an upper surface 2*a* and a bottom surface 2*b* and four side surfaces 2*c*, 2*d*, 2*e*, and 2*f* in a periphery thereof. A speaker unit SU2 is attached to, for example, the side surface 2*c* of the speaker device 2.

Transmission and reception units 22 and 23 are respectively provided on the side surface 2*d* and the side surface 2*f* which are side surfaces approximately orthogonal to the side surface 2*c*. A transmission and reception unit 22 includes a transmission section 22*a* and a reception section 22*b*. A transmission and reception unit 23 includes a transmission section 23*a* and a reception section 23*b*. In this manner, the transmission and reception units 22 and 23 include a pair of transmission and reception sections.

The transmission section 22*a* outputs an infrared ray signal $IR_L$ which is an example of a first signal. The transmission section 23*a* outputs an infrared ray signal $IR_R$ which is an example of the second signal. That is, the infrared ray signal $IR_L$ and the infrared ray signal $IR_R$ is output (emitted) in opposite directions with respect to a horizontal direction (left- and right-hand directions) approximately orthogonal to a direction of acoustic radiation of the speaker device 2. There is an advantage that the infrared ray signal can arrive at the counterpart by diffraction even if little obstacles exist and approximately 7 to 10 m can be secured as the communication distance like a remote control device using the infrared ray signal.

The infrared ray signal $IR_L$ and the infrared ray signal $IR_R$ are signals distinguishable from each other (characterized signals). For example, the infrared ray signal $IR_L$ and the infrared ray signal $IR_R$ are signals distinguishable on the basis of a difference in carrier frequency. By adding predetermined identifiers to the infrared ray signal $IR_L$ and the infrared ray signal $IR_R$, both may be distinguishable signals.

The reception section 22*b* detects the infrared ray signal $IR_R$ from the other speaker device, for example, the speaker device 3. Even when the reception section 22*b* receives the infrared ray signal IRL output from the transmission section 22*a* with which the reception section 22*b* is paired, the reception section 22*b* ignores (does not detect) reception of that signal in processing on software. The reception section 23*b* detects the infrared ray signal $IR_L$ output from the other speaker device, for example, the speaker device 3. Even when the reception section 23*b* receives the infrared ray signal $IR_R$ output from the transmission section 23*a* with which the reception section 23*b* is paired, the reception section 22*b* ignores (does not detect) reception of that signal in processing on software. As described above, the infrared ray signal $IR_L$ and the infrared ray signal $IR_R$ are characterized such that the infrared ray signal $IR_L$ and the infrared ray signal $IR_R$ can be distinguished. Therefore, for example, even when the reception section 22*b* receives the infrared ray signal $IR_L$, that signal does not have a characteristic included in the infrared ray signal $IR_L$. Therefore, the reception section 22*b* can ignore the infrared ray signal $IR_L$ even when the reception section 22*b* receives the infrared ray signal $IR_L$ and erroneous detection caused by signal interference and the like can be prevented.

[Configuration Example of Speaker Device]

Figure 3:
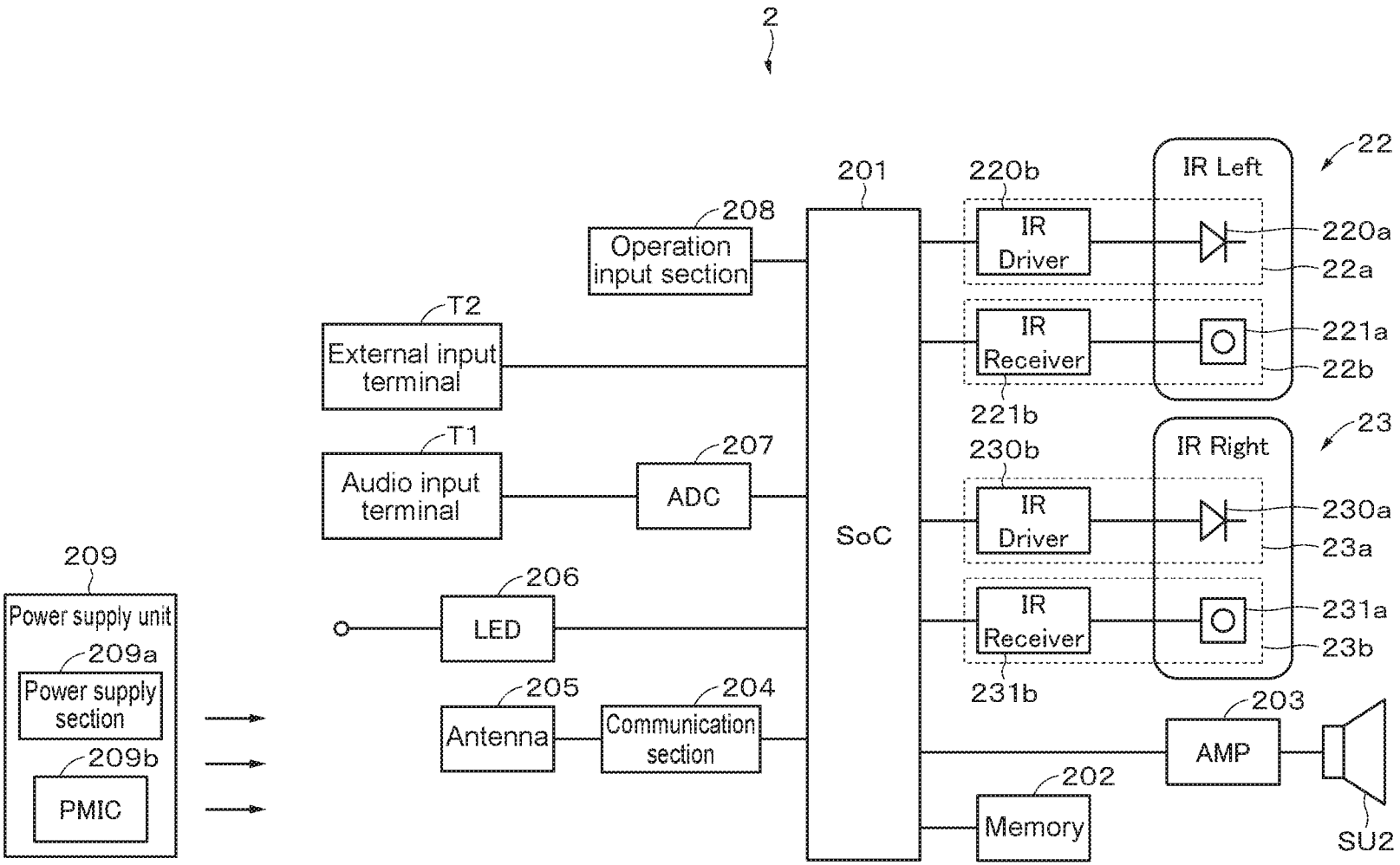
FIG. 3 is a block diagram showing a configuration example of the speaker device according to the embodiment.

FIG. 3 is a block diagram showing a configuration example of the speaker device 2. The speaker device 2 includes a system on chip (SoC) 201, a memory 202, an amplifier (AMP) 203, the speaker unit SU2, the above-mentioned transmission and reception units 22 and 23, a communication section 204, an antenna 205, a light emitting diode (LED) 206, an analog to digital converter (ADC) 207, an audio input terminal T1, an external input terminal T2, an operation input section 208, and a power supply unit 209.

The SoC 201 is an integrated circuit in which a microcontroller and the like are integrated on a chip of the integrated circuit. The SoC 201 controls the sections of the speaker device 2. The SoC 201 functions as an identification section that identifies the arrangement position of the speaker device 2 in accordance with results of reception by the reception section 22*b* and the reception section 23*b* for example.

The memory 202 is a generic term for a read only memory (ROM) in which programs to be executed by the SoC 201 are stored, a random access memory (RAM) to be used as a work area when executing the program, and the like.

The amplifier 203 amplifies audio data at a predetermined amplification factor. Sound corresponding to audio data output from the amplifier 203 is reproduced through the speaker unit SU2.

As described above, the transmission and reception unit 22 includes the transmission section 22*a* and the reception section 22*b*. The transmission section 22*a* includes a light-emitting element 220*a* and a driver (IR driver) 220*b* that controls light emission of the light-emitting element 220*a*. The driver 220*b* is operated in accordance with control of the SoC 201. Due to the operation of driver 220*b*, the light-emitting element 220*a* emits light. The reception section 22*b* includes a light-receiving element 221*a* and a receiver 221*b*. The receiver 221*b* determines whether or not an infrared ray signal received by the light-receiving element 221*a* is a predetermined infrared ray signal and notifies the SoC 201 of the result.

As described above, the transmission and reception unit 23 includes the transmission section 23*a* and the reception section 23*b*. The transmission section 23*a* includes a light-emitting element 230*a* and a driver (IR driver) 230*b* that drives light emission of the light-emitting element 230*a*. The driver 230*b* is operated in accordance with control of the SoC 201. Due to the operation of the driver 230*b*, the light-emitting element 230*a* emits light. The reception section 23*b* includes a light-receiving element 231*a* and a receiver 231*b*. The receiver 231*b* determines whether or not the infrared ray signal received by the light-receiving element 231*a* is a predetermined infrared ray signal and notifies the SoC 201 of the result.

The communication section 204 and the antenna 205 correspond to a configuration (communication section) that communicates with the audio data supplying device 1, for example. Demodulation processing, the error correction processing, and the like by the communication section 204 are performed on audio data received by the antenna 205 and the output of the communication section 204 is supplied to the amplifier 203 via the SoC 201. Sound corresponding to the audio data amplified by the amplifier 203 is output from the speaker unit SU2.

The LED 206 includes a driver that drives the LED and light emission of the LED and emits light in accordance with an operation state of the speaker device 2, battery remaining capacity information, and the like.

The ADC 207 converts audio data input from the audio input terminal T1 from the analog format into the digital format. The audio input terminal T1 is a terminal into which analog audio data is input from an external device or recording medium.

The external input terminal T2 is a terminal to which a semiconductor memory such as a Universal Serial Bus (USB) is connected.

The operation input section 208 is for instructing the speaker device 2 to control powering on and audio reproduction. The operation input section 208 may be a mechanical button and dial or may be a touch panel. The operation input section 208 may include both of them.

The power supply unit 209 includes a power supply section 209*a* and a power management IC (PMIC) 209*b*. The power supply section 209*a* is a power supply for the speaker device 2. The power supply section 209*a* is, for example, a secondary battery such as a rechargeable lithium-ion secondary battery or a primary battery such as a dry cell. The PMIC 209*b* converts the voltage of the power supply section 209*a* into a voltage (e.g., 3.3 V or 5 V) adaptive to the configuration (e.g., the SoC 201) to which that voltage is to be supplied.

The configuration of the speaker device 2 can also be applied to the speaker device 3. Schematically describing, the speaker device 3 includes a transmission and reception unit 32 (a transmission section 32*a* and a reception section 32*b*), a transmission and reception unit 33 (a transmission section 33*a* and a reception section 33*b*), an SoC 301, a speaker unit SU3, and the like. The transmission section 32*a* outputs the infrared ray signal $IR_L$. The transmission section 33*a* outputs the infrared ray signal $IR_R$.

[Operation Example of Speaker Device]

The speaker devices 2 and 3 automatically determine whether the speaker devices 2 and 3 are speaker devices arranged at the left or right by themselves and notify the audio data supplying device 1 of the results. The audio data supplying device 1 transmits audio data corresponding to the notified arrangement position to the speaker device of that arrangement position.

Figure 4:
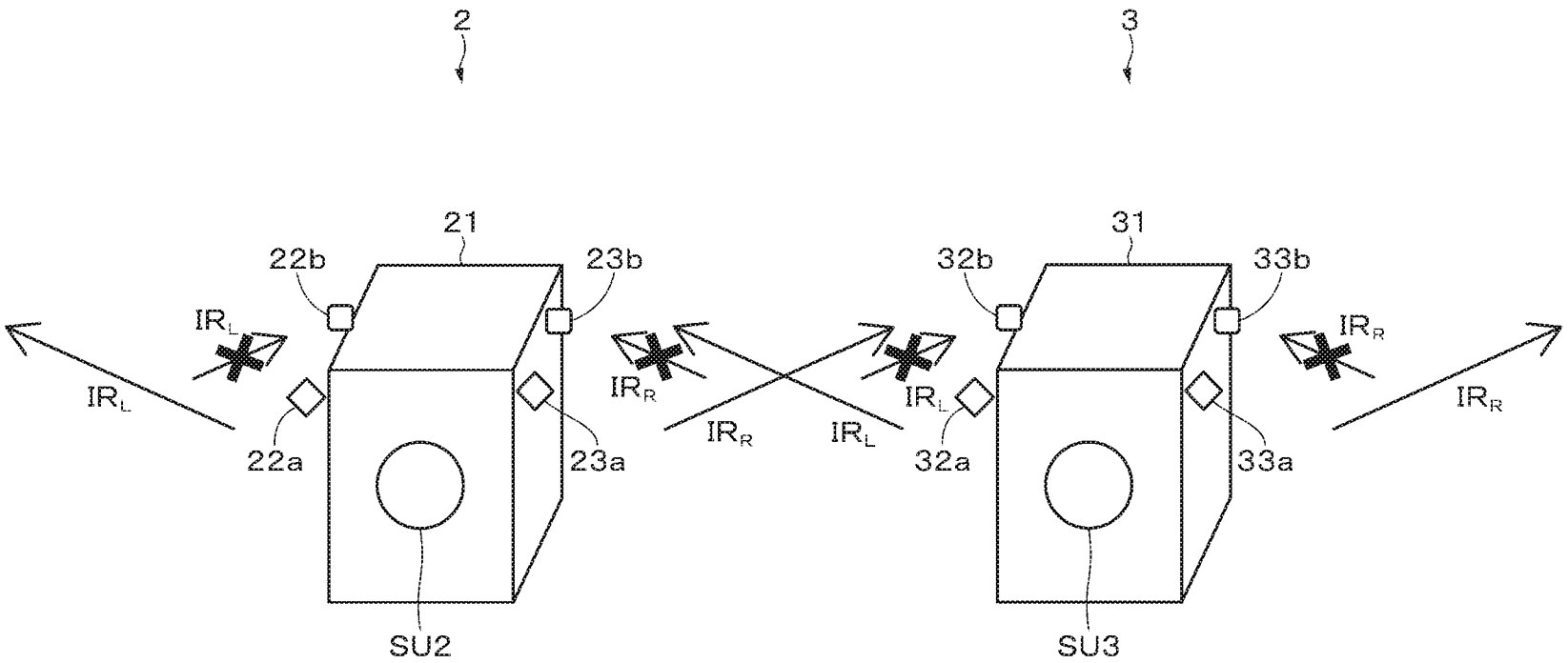
FIG. 4 is a diagram for describing an operation example of the audio data reproducing system according to the embodiment.

An example of processing in which the speaker devices 2 and 3 automatically determine the arrangement positions will be described with reference to FIG. 4. The example shown in FIG. 4 is an example in which with respect to the user, the speaker device 2 is arranged on the left-hand side (Left) and the speaker device 3 arranged on the right-hand side (Right). It should be noted that in FIG. 4, each reception section and each transmission section are shown in a schematically simplified manner.

The infrared ray signal $IR_L$ output from the transmission section 22*a* of the speaker device 2 is not detected by the reception section 22*b*. On the other hand, the reception section 23*b* detects the infrared ray signal $IR_L$ output from the transmission section 32*a* of the speaker device 3.

The infrared ray signal $IR_R$ output from the transmission section 33*a* of the speaker device 3 is not detected by the reception section 33*b*. On the other hand, the reception section 32*b* detects the infrared ray signal $IR_R$ output from the transmission section 23*a* of the speaker device 2.

In accordance with the detection results of the reception sections 22*b* and 23*b*, the SoC 201 of the speaker device 2 identifies the speaker device 2 itself as being the speaker device arranged on the left-hand side. Further, in accordance with the detection results of the reception sections 32*b* and 33*b*, the SoC 301 of the speaker device 3 identifies the speaker device 3 itself as being the speaker device arranged on the right-hand side.

On the other hand, in a case where the reception section 22*b* of the speaker device 2 detects the infrared ray signal $IR_R$ and the reception section 23*b* does not detect the infrared ray signal, the SoC 201 of the speaker device 2 identifies the speaker device 2 itself as being the speaker device arranged on the right-hand side. Further, in a case where the reception section 32*b* of the speaker device 3 does not detect the infrared ray signal and the reception section 33*b* detects the infrared ray signal $IR_L$, the SoC 301 of the speaker device 3 identifies the speaker device 3 itself as being the speaker device arranged on the left-hand side.

Hereinabove, the detection results of the reception sections and the arrangement positions of the speakers identified in accordance with those detection results are collectively shown in Table 1 below.

TABLE 1

| | Speaker device 2 | | Speaker device 3 | | |
|---|---|---|---|---|---|
| | Reception section 22b | Reception section 23b | Reception section 32b | Reception section 33b | |
| Case 1 | Not detected | $IR_L$ detected | $IR_R$ detected | Not detected | Speaker device 2 is left and speaker device 3 is right |

TABLE 1-continued

| | Speaker device 2 | | Speaker device 3 | | |
|---|---|---|---|---|---|
| | Reception section 22b | Reception section 23b | Reception section 32b | Reception section 33b | |
| Case 2 | $IR_R$ detected | Not detected | Not detected | $IR_L$ detected | Speaker device 2 is left and speaker device 3 is right |

[Flow of Processing]

Figure 5:
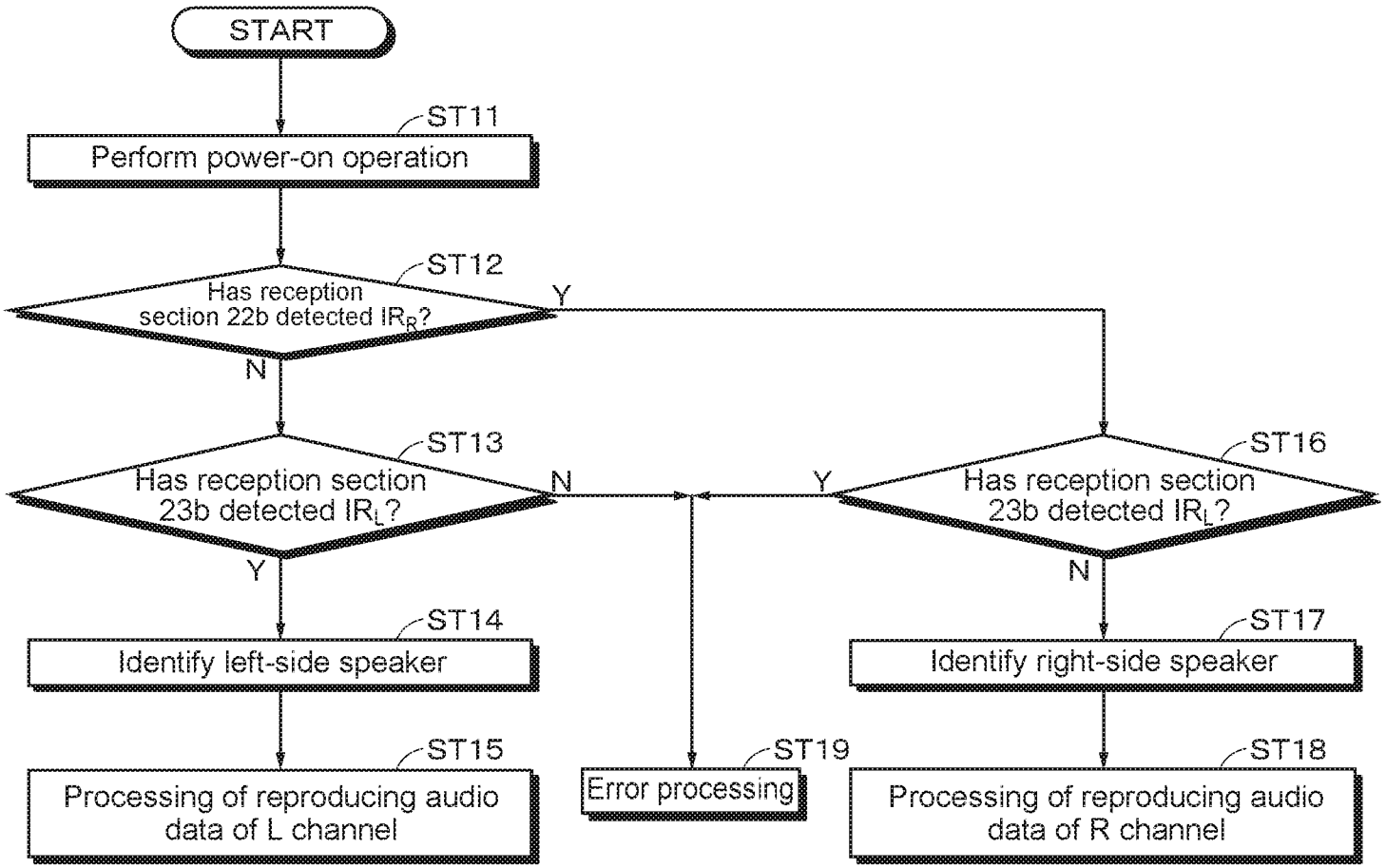
FIG. 5 is a flowchart for describing an operation example of the speaker device according to the embodiment.

FIG. 5 is a flowchart showing a flow of processing performed in the speaker device 2. It should be noted that the processing shown hereinafter is performed by the SoC 201 unless otherwise stated. In Step ST11, it is detected that the operation of powering on the speaker device 2 is performed. The operation of powering on the speaker device 2 is performed by pressing a power button provided in the speaker device 2 which is an example of the operation input section 208. Then, the processing proceeds to Step ST12.

The processing of identifying the position of the speaker device 2 is performed by using the power-on operation as a trigger, for example. In Step ST12, it is determined whether or not the reception section 22*b* has detected the infrared ray signal $IR_R$. If the reception section 22*b* has not detected the infrared ray signal $IR_R$ (negative determination), the processing proceeds to Step ST13.

In Step ST13, it is determined whether or not the reception section 23*b* has detected the infrared ray signal $IR_L$. If the reception section 23*b* has detected the infrared ray signal $IR_L$ (positive determination), the processing proceeds to Step ST14. In Step ST14, the SoC 201 identifies the speaker device 2 as being the speaker device arranged on the left-hand side. Then, the processing proceeds to Step ST15.

In Step ST15, processing of reproducing the audio data of the L channel is performed under the control of the SoC 201. For example, the SoC 201 controls the communication section 204 and notifies the audio data supplying device 1 of its own arrangement position (on the left-hand side) via the antenna 205. The audio data supplying device 1 transmits the audio data of the L channel depending on the arrangement position to the speaker device 2 in accordance with notification from the speaker device 2.

The audio data of the L channel transmitted from the audio data supplying device 1 is received by the antenna 205 of the speaker device 2 and the demodulation processing and the like is performed by the communication section 204. Then, after the audio data on which the demodulation processing and the like have been performed is converted into analog audio data by the DAC function of the SoC 201, the analog audio data is supplied to the amplifier 203. The audio data amplified with a predetermined amplification factor by the amplifier 203 is reproduced through the speaker unit SU2.

It should be noted that if the reception section 23 b has not detected the infrared ray signal $IR_L$ (negative determination), the processing proceeds to Step ST19. If no infrared ray signals are detected by both of the reception sections 22*b* and 23*b* (e.g., if the speaker device are too far from each other or if there is an obstacle such as a wall), its own arrangement position cannot be identified, and thus error processing is performed in Step ST19. Processing having suitable contents such as processing of blinking the LED 206 can be performed as the error processing.

In Step ST12, if the reception section 22*b* has detected the infrared ray signal $IR_R$ (positive determination), the processing proceeds to Step ST16. In Step ST16, it is determined whether or not the reception section 23*b* has detected the infrared ray signal $IR_L$. If the reception section 23*b* has not detected the infrared ray signal $IR_L$ (negative determination), the processing proceeds to Step ST17. In Step ST17, the SoC 201 identifies the speaker device 2 as being the speaker device arranged on the right-hand side. Then, the processing proceeds to Step ST18.

In Step ST18, processing of reproducing the audio data of the R channel is performed under the control of the SoC 201. For example, the SoC 201 controls the communication section 204 and notifies the audio data supplying device 1 of its own arrangement position (on the right-hand side) via the antenna 205. The audio data supplying device 1 transmits the audio data of the R channel depending on the arrangement position to the speaker device 2 in accordance with notification from the speaker device 2.

The audio data of the R channel transmitted from the audio data supplying device 1 is received by the antenna 205 of the speaker device 2 and the demodulation processing and the like are performed by the communication section 204. Then, after the audio data on which the demodulation processing and the like have been performed is converted into analog audio data by the DAC function of the SoC 201, the analog audio data is supplied to the amplifier 203. The audio data amplified by the amplifier 203 with a predetermined amplification factor is reproduced through the speaker unit SU2.

It should be noted that in Step ST16, if the reception section 23*b* has detected the infrared ray signal $IR_L$ (positive determination), the arrangement position of the speaker device 2 cannot be correctly identified, and thus the processing proceeds to Step ST19. Then, the error processing is performed.

It should be noted that the processing at the speaker device 2 is also performed at the speaker device 3 in a similar way and its own arrangement position is identified also at the speaker device 3.

[Effects]

In accordance with the above-mentioned embodiment, for example, the following effects can be obtained.

Only by arranging two speaker devices, for example, relative positions of those speaker devices, for example, whether those speaker devices are arranged on the left-hand side or on the right-hand side can be determined.

Setting of an output channel and the like to the speaker device can be automized.

Settings of a wireless speaker can be automatically determined only by placing the wireless speaker, and thus a user's setting operation becomes unnecessary.

2. Modified Examples

Although the embodiment of the present disclosure has been specifically described hereinabove, the contents of the present disclosure are not limited to the embodiment and various modifications can be made based on the technical ideas of the present disclosure.

In the above-mentioned embodiment, the positions at which the transmission and reception units 22 and 23 are provided do not need to be the side surfaces 2*d*, 2*f*. For example, the transmission and reception units 22 and 23 may be provided on both sides of a projection projecting upward from the upper surface 2*a*. That is, if a direction approximately orthogonal to a direction for emitting sound, the infrared ray signal $IR_L$ and the infrared ray signal $IR_R$ are output in opposite directions, the positions at which the transmission and reception units 22 and 23 are provided can be changed as appropriate.

In the above-mentioned embodiment, the audio signals of the two channels have been exemplified. The present disclosure can also be applied to an audio data reproducing system using audio data of 5.1 channel and the like. In accordance with the configuration of the audio data reproducing system, the infrared ray signal may be configured to be output in a direction that forms a predetermined angle (45 degrees, 120 degrees, or the like) with respect to a direction for emitting sound.

In the above-mentioned embodiment, the audio data of the two channels may be output from the audio data supplying device 1. Then, the audio data of the channel corresponding to the identified arrangement position, which is the audio data of the two channels supplied from the audio data supplying device 1 on sides of the speaker devices 2 and 3 may be selected and reproduced. This processing is performed in such a manner that the SoC 201 or 301 function as a selector section that selects the audio data of the channel corresponding to the arrangement position, for example.

In order to prevent placement in which the speaker devices 2 and 3 are upside down, marcs or the like may be added to enclosures 21 and 31 of the speaker devices 2 and 3. Alternatively, acceleration sensor or geomagnetic sensors may be provided for informing of the placement in which the speaker devices 2 and 3 are upside down in accordance with detection results of the sensors.

In the above-mentioned embodiment, the processing for the speaker devices 2 and 3 to identify their own arrangement positions may be performed by using an instruction or the like from the audio data supplying device 1 as a trigger instead of the power-on operation.

As long as signals output by the transmission section 22*a* and the transmission section 32*a* are distinguishable signals, those are not limited to the infrared ray signals and may be radio wave signals. Further, the configurations of the speaker devices 2 and 3 can be changed as appropriate. For example, the speaker devices 2 and 3 may include the display units.

In the above-mentioned embodiment, for example, using a proximity profile of Bluetooth low energy (BLE), a rough distance between the speaker devices may be measured. Further, using BLE communication for a smartphone to add BLE tags also on the sides of the speaker devices, for example, communication is established, such that the distance up to an arbitrary speaker device may be configured to be roughly measured by using the proximity profile of the BLE. Rough positions of the individual speaker devices may be determined in accordance with results of distance measurement and rough arrangement of two or more speaker devices may be detected. With this configuration, positions of a group of speaker devices having a large-scale and complicated configuration can be estimated.

The configurations, methods, processes, shapes, materials, and numerical values, etc. shown in the above-mentioned embodiments are merely examples and other configurations, methods, processes, shapes, materials, and numerical values, etc. may be used depending on needs. The embodiment and the modified example can be combined as appropriate.

It should be noted that the present disclosure can also take configurations as follows.

(1) A speaker device, including:

a first output section that outputs a first signal; and a second output section that outputs a second signal distinguishable from the first signal.

(2) The speaker device according to (1), in which the first signal and the second signal include signals distinguishable on the basis of a difference in carrier frequency.

(3) The speaker device according to (1), in which the first signal and the second signal include signals distinguishable on the basis of identifiers included in the signals.

(4) The speaker device according to any of (1) to (3), in which the first signal and the second signal are output in opposite directions with respect to a horizontal direction approximately orthogonal to a direction for emitting sound.

(5) The speaker device according to any of (1) to (4), including:

a first reception section that receives the second signal; and a second reception section that receives the first signal.

(6) The speaker device according to (5), in which an identification section that identifies an arrangement position in accordance with results of reception by the first reception section and the second reception section.

(7) The speaker device according to (6), including a communication section that notifies of the arrangement position by communication with an audio data supplying device.

(8) The speaker device according to (6), including a selector section that selects audio data of a channel corresponding to the arrangement position.

(9) The speaker device according to any of (1) to (8), including an enclosure that forms a rectangular parallelepiped shape, in which a speaker unit is provided on a first surface, and the first output section and the second output section are respectively provided on two side surfaces located in a direction approximately orthogonal to the first surface.

(10) The speaker device according to any of (1) to (9), which has a portable size.

(11) The speaker device according to any of (1) to (10), in which the first signal and the second signal include either an infrared ray signal or a radio wave signal.

(12) An audio data reproducing system, including:

at least two or more speaker devices; and an audio data supplying device that supplies each of the speaker devices with audio data, in which the speaker device includes a first output section that outputs a first signal, a second output section that outputs a second signal distinguishable from the first signal, a first reception section that receives the second signal, a second reception section that receives the first signal, an identification section that identifies an arrangement position in accordance with results of reception by the first reception section and the second reception section, and a communication section that notifies the audio data supplying device of the arrangement position by communication, and the audio data supplying device includes a supplying section that supplies the speaker device with audio data of a channel by the communication, the channel corresponding to an arrangement position notified by the speaker device.

REFERENCE SIGNS LIST

1 audio data supplying device
2, 3 speaker device
22*a*, 32*a* transmission section
23*a*, 22*a* transmission section
100 audio data reproducing system
201, 301 SoC
$IR_R$, $IR_L$ infrared ray signal

The invention claimed is:

1. A speaker device, comprising:

a first output section configured to output a first signal in a first direction;

a second output section configured to output a second signal in a second direction;

a first reception section configured to receive a third signal corresponding to the second signal and ignore reception of the first signal; and a second reception section configured to receive a fourth signal corresponding to the first signal and ignore reception of the second signal, wherein each of the first output section and the first reception section is on a first side of the speaker device, each of the second output section and the second reception section is on a second side of the speaker device, the first side of the speaker device is opposite to the second side of the speaker device, the first direction is opposite to the second direction with respect to a horizontal direction, the horizontal direction is approximately orthogonal to a direction of emission of sound by the speaker device, and the second signal is distinguishable from the first signal based on a specific identifier included in each of the first signal and the second signal.

2. The speaker device according to claim 1, wherein the first signal is distinguishable from the second signal based on a difference in a carrier frequency of the first signal and a carrier frequency of the second signal.

3. The speaker device according to claim 1, further comprising an identification section configured to identify an arrangement position of the speaker device based on the third signal and the fourth signal.

4. The speaker device according to claim 3, further comprising a communication section configured to:

communicate with an audio data supplying device; and notify the audio data supplying device of the arrangement position based on the communication.

5. The speaker device according to claim 3, further comprising a selector section configured to select audio data of a channel corresponding to the arrangement position.

6. The speaker device according to claim 1, further comprising:

an enclosure that has a rectangular parallelepiped shape; and a speaker unit on a specific surface of the enclosure, wherein the first output section and the second output section are respectively on two side surfaces of the enclosure, and the two side surfaces are located in a direction approximately orthogonal to the specific surface.

7. The speaker device according to claim 1, wherein the speaker device has a portable size.

8. The speaker device according to claim 1, wherein each of the first signal and the second signal includes either an infrared ray signal or a radio wave signal.

9. An audio data reproducing system, comprising:

at least two speaker devices; and an audio data supplying device configured to supply each of the at least two speaker devices with audio data, wherein a speaker device of the at least two speaker devices includes:

a first output section configured to output a first signal in a first direction, a second output section configured to output a second signal in a second direction, wherein the first direction is opposite to the second direction with respect to a horizontal direction, the horizontal direction is approximately orthogonal to a direction of emission of sound by the speaker device, and the second signal is distinguishable from the first signal based on a specific identifier included in each of the first signal and the second signal, a first reception section configured to receive a third signal corresponding to the second signal and ignore reception of the first signal, a second reception section configured to receive a fourth signal corresponding to the first signal and ignore reception of the second signal, wherein each of the first output section and the first reception section is on a first side of the speaker device, each of the second output section and the second reception section is on a second side of the speaker device, and the first side of the speaker device is opposite to the second side of the speaker device, an identification section configured to identify an arrangement position of the speaker device based on the third signal and the fourth signal, and a communication section configured to:

communicate with the audio data supplying device, and notify the audio data supplying device of the arrangement position based on the communication, the audio data supplying device includes a supplying section configured to supply the speaker device with the audio data of a channel based on the communication, and the channel corresponds to the arrangement position notified by the communication section.

* * * * *